US010464196B2

(12) United States Patent
Hale

(10) Patent No.: US 10,464,196 B2
(45) Date of Patent: Nov. 5, 2019

(54) BOARD FASTENING TOOL

(71) Applicant: Patrick Hale, Hamilton (CA)

(72) Inventor: Patrick Hale, Hamilton (CA)

( * ) Notice: Subject to any disclaimer, the term of this patent is extended or adjusted under 35 U.S.C. 154(b) by 349 days.

(21) Appl. No.: 15/353,728

(22) Filed: Nov. 16, 2016

(65) Prior Publication Data

US 2017/0066115 A1 Mar. 9, 2017

Related U.S. Application Data

(63) Continuation-in-part of application No. 13/650,436, filed on Oct. 12, 2012, now abandoned.

(51) Int. Cl.
*B25C 1/02* (2006.01)
*B25C 1/04* (2006.01)

(52) U.S. Cl.
CPC ..... *B25C 1/04* (2013.01); *B25C 1/02* (2013.01); *B25C 1/047* (2013.01)

(58) Field of Classification Search
CPC .... B25C 1/00; B25C 1/02; B25C 1/04; B25C 1/047
USPC ..... 227/145, 148
See application file for complete search history.

(56) References Cited

U.S. PATENT DOCUMENTS 2,284,517 A * 5/1942 Fink ..... A01D 34/23 56/236
2,475,527 A * 7/1949 Stilwell ..... B25C 1/00 227/145
3,542,273 A * 11/1970 Hedrick ..... B25C 1/041 227/130
4,751,970 A * 6/1988 Hecker ..... B23B 45/003 173/104
6,227,075 B1 * 5/2001 Carmien ..... B25D 1/12 81/22
8,635,931 B2 * 1/2014 Fafet ..... F16D 3/77 74/574.4
2005/0023325 A1 * 2/2005 Gresham ..... A61B 17/115 227/176.1

* cited by examiner

*Primary Examiner* — Gloria R Weeks
*Assistant Examiner* — Patrick B Fry
(74) *Attorney, Agent, or Firm* — Stuart L. Wilkinson

(57) ABSTRACT

A board fastening tool has a tool body and a driver having contiguous drive elements mounted in the body. A top element is mounted to slide in vertical track when hit from above. A bottom element is mounted to drive a fastener diagonally out of the body and into a board to fix the board to the floor. The top and bottom elements are connected by a spring steel ribbon device sliding in a curved track so that vertical movement of the top element is converted to diagonal movement of the bottom element. The spring steel ribbon device has a pair of spring steel ribbons joined to each other at respective ends thereof and separate from each other over an intermediate region.

17 Claims, 6 Drawing Sheets

BOARD FASTENING TOOL

CROSS REFERENCE TO RELATED PATENTS

The present application is a continuation-in-part of and claims priority from, U.S. patent application Ser. No. 13/650,436 filed Oct. 12, 2012, entitled "Fastening tool and method of operation", the contents of which are incorporated herein by reference and in their entirety for all purposes.

FIELD OF THE INVENTION

This invention relates to a board fastening tools and has particular application for fastening floorboards to a subfloor where the board has to be fixed very close to a wall.

DESCRIPTION OF RELATED ART

Floorboards for hardwood floors are generally milled as lengths of several feet and widths of a few inches. Typically the boards are from a half to one inch in thickness with one edge formed with a tongue and the other edge formed with a matching groove. The boards are laid edge to edge with the tongue of one board inserted into the groove of the next adjacent board. The boards are laid successively from one wall of the room being covered. For a neat appearance and to avoid the presence of grooves between adjacent boards where detritus can gather, a board being nailed is pressed tightly against the previously laid board before it is fastened.

Generally boards are fastened using nails or staples so that the fastener is not visible in the finished floor. One way of doing this is to drive the fastener diagonally into the side of the board so that the fastener penetrates the edge of the board at an entry position spaced from the top face of the board. The fastener is driven through a lower part of the board, exits the bottom face of the board and enters the subfloor. The fastener is driven some way into the subfloor and the frictional grip between the leading part of the nail or staple and the subfloor material such as plywood retains the fastened board in position against the subfloor and against its neighboring board. The boards are laid in sequence so that the grooved edges face the starting wall and fasteners are driven through the tongued edges. The fastener is driven into the tongued edge at 45 degrees to the vertical at the corner junction between the top edge portion of the board and the top face of the tongue. In this way, the fastener does not protrude in such a way as might adversely affect the fitting of the next board to be fastened against the board previously fastened. The successive fastening in this way means that an essentially integral floor structure is obtained with each fastening of a board contributing through the tightly interlocking of the tongue and groove arrangement to the clamping in place of its neighboring boards.

The angled drive applied to a fastener has two mechanical effects. Firstly, the horizontal component of the applied angled drive presses a board to be fastened laterally against the previously laid board so that the respective tongue and groove are locked and the adjacent edges of the two boards are pressed tightly together. Secondly, the vertical component of the applied angled drive presses the board being fastened firmly against the subfloor so that there is no gap between the board and the subfloor after the fastening operation is complete. The two mechanical effects overlap during the driving operation so that the lateral pressure is applied to the board as it is fixed to the subfloor.

A conventional fastening tool has a cartridge of fasteners such as staples or nails, a multiple charge of fasteners being spring mounted in the cartridge so as to bias a leading fastener into a position ready for its being driven. The tool has a rebated shoe which is used to locate the tool next to a board in the proper position for executing a fastening operation. The rebate is dimensioned so that its top face sits on top of the board to be fastened, its vertical face fits against the tongued end of that board, and an adjacent heel section of the shoe rests on the subfloor. The shoe has a launch aperture through which the readied fastener is driven in an operation as previously described. Once the fastener is driven into the board, the next adjacent fastener in the cartridge is spring biased into the ready position and the tool is lifted away from the board and located against another section of the board edge in preparation for driving another fastener.

In order that the fastener is effectively driven through the board and into the subfloor, a drive must be applied longitudinally to the fastener; i.e. along the line of the shank in the case of a nail and along the line of the two penetrating spikes in the case of the staple which is generally of the form of an inverted U. The drive applied is a percussive drive rather than the application of a high, non-percussive force. This, in turn, means that a hammer element such as a hammer head or a piston must gain momentum before it strikes the readied fastener to drive it through an edge portion of a board and into the subfloor. In a mechanical version of the flooring tool, a piston is spring mounted for reciprocation in a tool barrel. The piston has a leading edge adapted to strike the readied fastener and a strike head at the other end of the piston which is hammered to effect piston movement against the spring mounting to drive the leading edge against the fastener. In the case where such a tool uses an adjunct power source, there is usually a two-phase drive. Typically, such an adjunct power source is compressed air, although power sources, such as electromagnetism, flammable expanding gases (e.g. propane), or a small explosive charge may alternatively be used. It is understood that although compressed air is the favored and effectively the most used fluid for fastener driving tools, other suitable compressible fluids or other power adjuncts could be used without departing from the scope of the present invention. For a compressed air powered driving tool, a top piston is first hammered against a spring bias to initiate drive of the top piston along a barrel. At a certain distance along its travel, the top piston clears an aperture in a wall of the barrel allowing fluid communication with a source of compressed air. Compressed air is then injected into the barrel to force a bottom piston against the readied fastener.

One issue with known board fastening tools is that a finite travel of the piston (or pistons in the case of the compressed air tool) in the barrel is needed to generate the required momentum for the fastener to be driven into the board and subfloor from its readied position. In addition, a swing of the hammer is required that further lengthens the drive room needed. Because swinging the hammer and driving the piston along the inclined barrel occur in the direction that the boards are being laid—i.e. away from the starting wall—this means that as illustrated by FIG. 1, the driving tool cannot be used to fasten the last few boards before the finishing wall. The number of rows is dependent on the width of the boards. Typically, for 3 inch boards, operation on the last four rows is prevented; for 4.5 inch boards, operation on the last 3 rows is prevented, etc. To finish the installation a different nail gun, known as a "brad-nailer", is used, this tool using a smaller gauge nail; 1-2" in comparison with a 2"

staple conventionally used by the board fastening tool. Such nailers are less effective for fastening floorboards as they do not provide the desired angular drive to a fastener.

SUMMARY OF THE INVENTION

According to an aspect of the invention, there is provided a board fastening tool having a tool body and first, second and third contiguous drive elements mounted in the tool body, the first element mounted to slide in a first linear direction along a first linear track section within the tool body upon a trailing end of the first element receiving a hammer blow directed generally in the first direction, the second element mounted to slide in a second linear direction different from the first linear direction along a second linear track section whereby a leading end of the second element drives a trailing end of a fastener mounted in the body in the second direction, the third element being an elongate, spring metal ribbon device having a trailing end thereof integral with a leading end of the first element and a leading end thereof integral with a trailing end of the second element, the third element mounted to slide along a third curved track section extending between the first and second track sections, the third element conformable to the curvature of the third track section on sliding longitudinally therealong, the spring metal ribbon device having a pair of spring metal ribbons joined to each other at respective ends thereof and separate from each other over an intermediate region thereof.

Preferably, the ribbons are made of spring steel, with one of the ribbons being longer than the other, the longer ribbon located towards the outside of the curve of the third curved track section and the shorter ribbon located towards the inside of the curve of the third curved track section. In operation, stresses within the double ribbon structure are reduced compared with a single ribbon of comparable size and operated in a similar track. Preferably, stresses in the double ribbon driver are reduced further by configuring the third curved track section so as to have a width varying along at least a part of its length in a plane normal to the curve of the third curved track section.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 2:
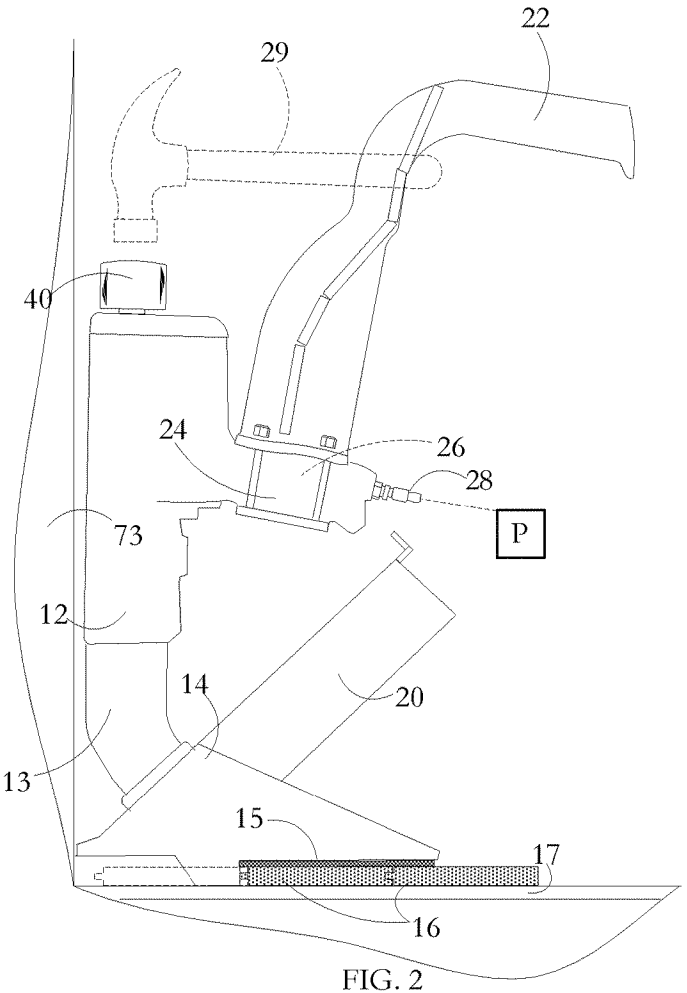
FIG. 2 is a side view of a floorboard driving tool embodying the invention.
Figure 1:
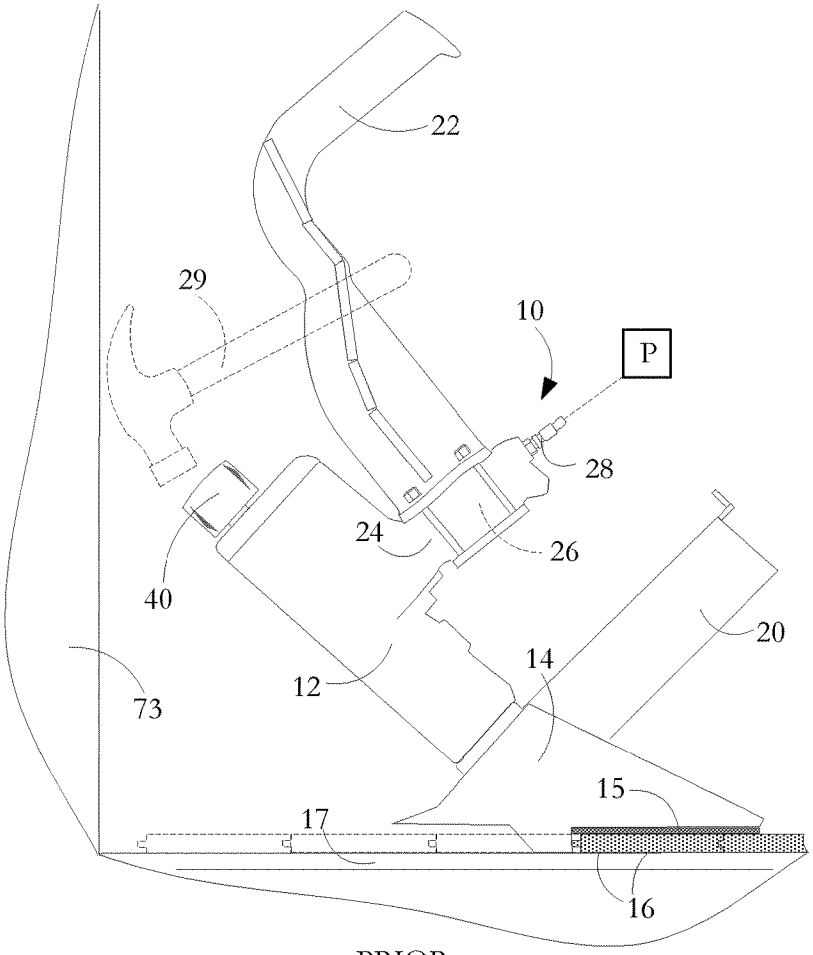
FIG. 1 PRIOR ART
FIG. 1 is a side view of a floorboard driving tool known in the prior art.
Figure 6:
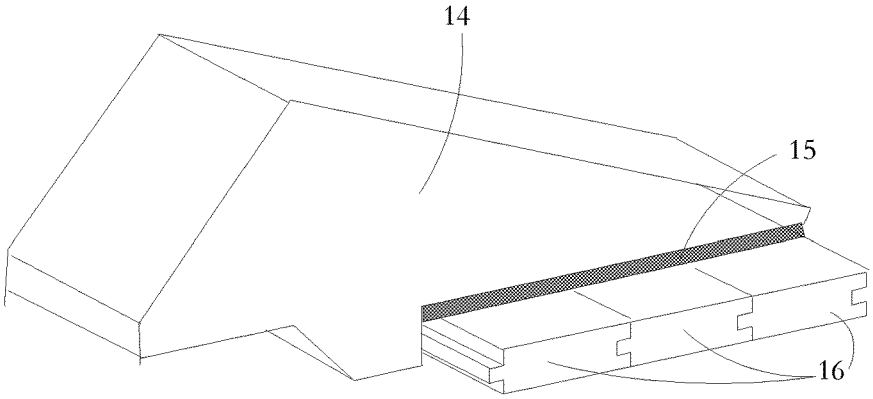
FIG. 6 is a perspective view showing a shoe forming part of a floorboard fastening tool, the shoe shown in juxtaposition to floorboards being fastened to a subfloor.

FIGS. 1 and 2 shows pneumatic fastener driving tools 10, each having a hollow generally barrel-form body 12. A shoe 14 for engaging a tongue and grooved floorboard 16 to be fastened to a sub-floor 17 is mounted at a lower end of the body 12. The shoe 14 includes a passage for receiving a leading fastener from a spring-loaded series of fasteners fed from a magazine 20. The fasteners are conventionally either nails or staples. In use, the passage guides the lead fastener from a strike position into the tongued end of a floorboard 16 to be fastened with the floorboard located under the shoe 14 as shown in FIG. 6 as the lead fastener is driven out of the driving tool 10. Because any of a range of thicknesses of board may be used, a spacer 15 is attached to an underside rebated part of the shoe 14 so as to adapt the rebate height to the thickness of boards 16 to be fastened to the subfloor 17. The fastener driving tool 10 has a handle 22 mounted to a spur member 24 projecting from the body and integral with it. The spur member 24 has an inner chamber 26 for containing a charge of compressed air, the member having a connector 28 in its wall for connection to a source P of compressed air. Driving of a fastener into the edge of a board and into the subfloor is initiated by swinging a hammer 29 and striking a cap covered anvil 40. The tool of FIG. 1 is known prior art. The tool of FIG. 2 tool has a coupling section 13 linking the barrel body 12 and an upper part of the shoe 14 and embodies principles of the present invention.

Figure 5:
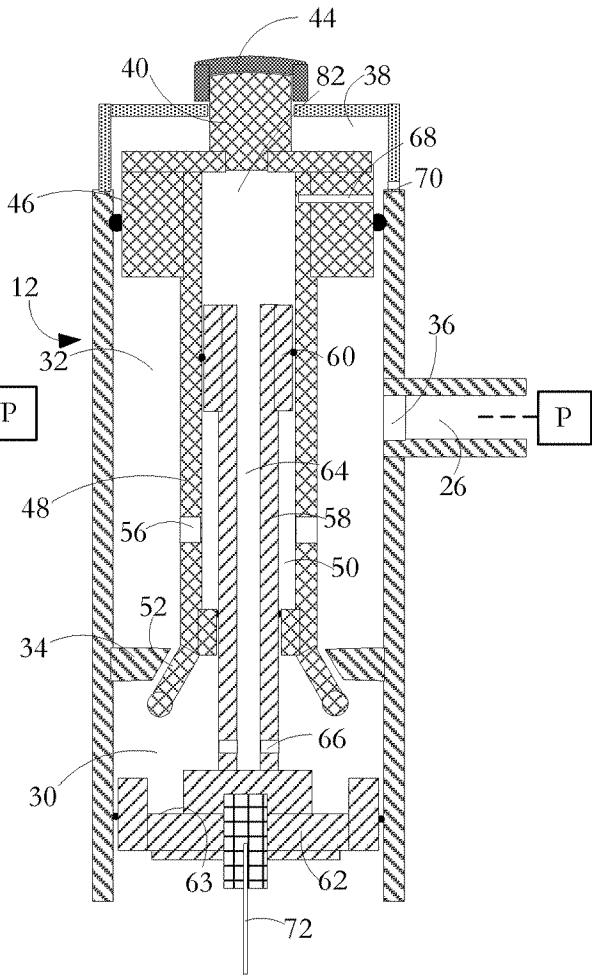
FIGS. 3 to 5 are vertical section views through a body section of the tool of FIG. 2 showing stages in the use of an adjunct power source to drive fasteners according to an embodiment of the invention.
Figure 4:
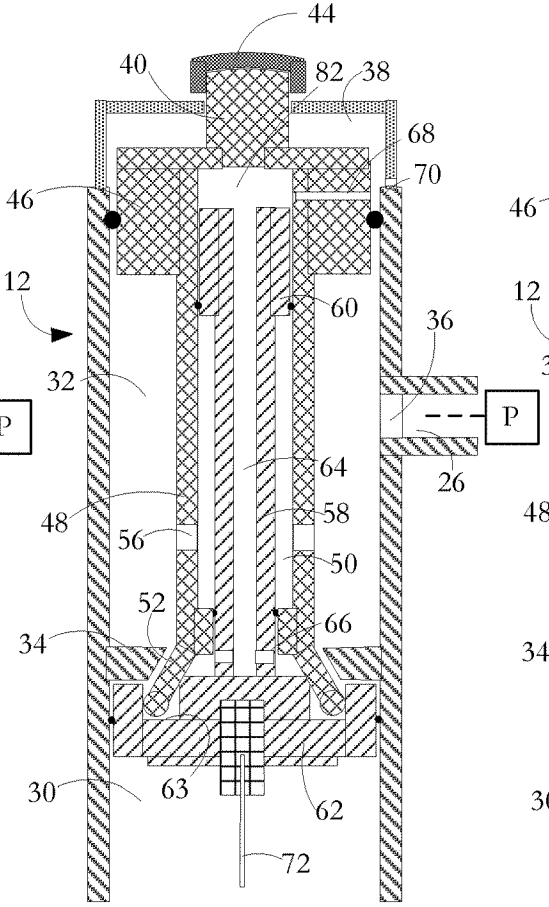
Figure 3:
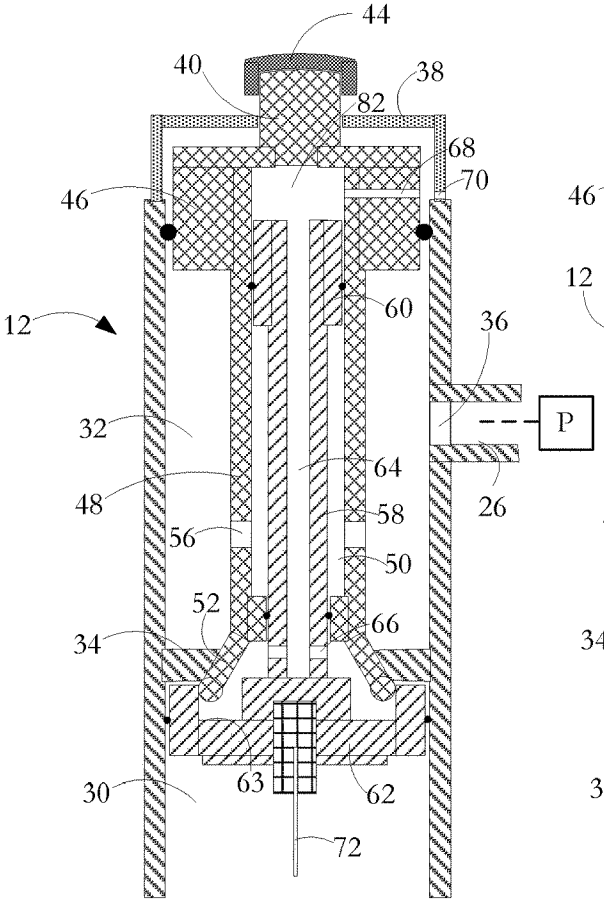

Shown in sectional view in FIGS. 3 to 5 is an arrangement of elements for the tool of FIG. 2, the elements functioning to provide compressed air from a power source P for converting a blow from the hammer 29 applied to the anvil 40 to an impulsive or percussive force of desired power and speed at a readied fastener. The body 12 has lower and upper chambers, respectively, 30 and 32. An annular seat 34 integrally formed with the body inner wall separates the chambers 30 and 32. An opening 36 permits continuous air exchange between the chambers 26 and 32. The body 12 is fitted at its upper end with a cover 38 from which protrudes a slidable anvil member 40 through a top opening 42, the anvil member 40 being covered with a soft cap 44. Anvil member 40 is attached at its lower end to an annular actuator 46 which seals against the interior of chamber 32 and is axially slidable along it. The actuator 46 sealingly engages the outer surface of a hollow cylindrical poppet valve 48 which has an inner channel 50. A lower end of the poppet valve 48 is formed with a conical valve head 52 which is operable to engage with and disengage from a face of the complementarily shaped annular seat 34. Poppet valve member 48 has several radial bores 56 located near valve head 52. A hollow piston 58 is axially slidable inside the channel 50, the piston 58 being guided by means of a sleeve 60 which slidably and sealingly engages the inner wall of poppet valve member 48 at an upper end of the piston. The piston 58 is guided at its lower end by a disc 62 attached to the piston 58 which slidingly and sealingly engages the main body 12 inner wall, the disc 62 having a dish form upper surface 63. A bore 64 extends longitudinally through the centre of the piston 58, the bore providing fluid communication via vent passages 66 between a portion of the upper chamber 32 located above actuator 46 and the portion of lower chamber 30 located above slider disc 62. Exhaust holes 68 are located between the lower end of anvil 40 and the upper end of actuator 46, the holes being in registration with corresponding exhaust holes 70 in cover 38.

Figure 7:
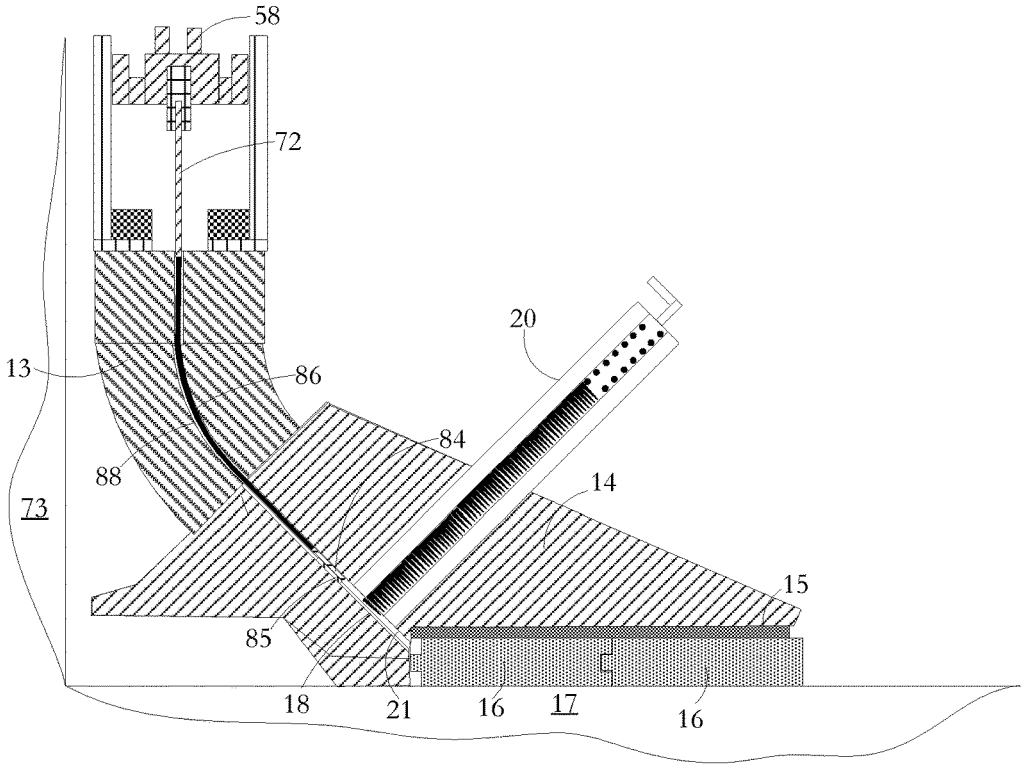
FIG. 7 is a vertical sectional view through a lower section of the tool of FIG. 2 showing the tool in a strike (or "fastener ready") condition.
Figure 8:
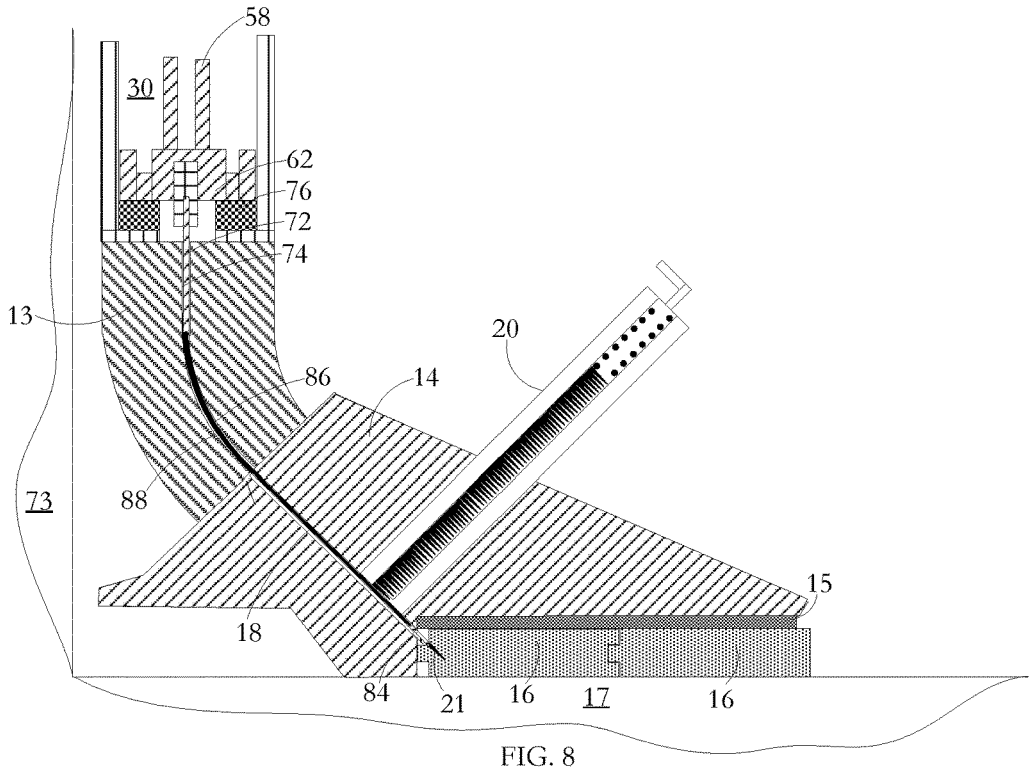
FIG. 8 is a vertical sectional view corresponding to the view of FIG. 7, but showing the tool following completion of a fastening operation.

A driver member 72 is attached to the lower end of piston 58 and is vertically drivable into and out of a straight vertical track section 74 in shoe 14 (FIGS. 7 and 8). A pad 76 is located at the bottom end portion of lower chamber 30, to receive and absorb the impact of the downwardly propelled disc 62. The lower and upper chambers 30, 32 are lined to enable smooth sliding engagement of disc 62 in lower chamber 30 and of actuator 46 in upper chamber 32. The anvil 40 encloses a chamber 82 which acts as a shock absorber to dampen upward movement of piston 58 when the piston is biased upwardly after a fastener has been driven by the action of the compressed air on the sleeve 60. Once the upper ends of sleeve 60 and piston 58 move into chamber 82, the air trapped in the chamber acts as a dampening cushion to reduce the impact during use of the piston slider disc 62 against lower seat 34.

Referring to FIGS. 7 and 8, a driver has three contiguous elements: a generally vertically disposed driver member 72, a blade tip 84, and a member 86 of a flexible spring metal such as steel extending between the driver member 72 and the blade tip 84. The driver member 72 is mounted centrally of the piston 58 and has a lower part received in a vertical track section 74 formed in the coupling section 13. The drive member 72 is driven vertically up and down with the movement of the piston 58 previously described with reference to FIGS. 3 to 5. The blade tip 84 is mounted for reciprocal linear movement within the inclined passage 18 in the shoe 14. A lead fastener 21 from the fasteners stored in the magazine 20 is automatically biased to a ready or strike position in the passage 18 as shown in FIG. 7. The spring steel member 86 is reciprocally moveable within a curved track 88 in the coupling section 13, the curved track contiguous with the track sections 18 and 74. The spring steel member 86 transforms the vertical reciprocation of the driver member 72 into reciprocation of the blade tip 84 within the angled passage 18. The driver member 72 and the blade tip 84 are made of hardened steel and the member 86 is made of spring steel. Examples of suitable spring steel are as follows, the chrome-silicon spring steel being especially valuable for its fatigue resistance.

| Material | SAE grade | Composition | Yield strength | Hardness |
|---|---|---|---|---|
| Blue spring steel | 1095 | 0.9-1.03% carbon, 0.3-0.5% manganese, up to 0.04% phosphorus, and up to 0.05% silicon | 413-517 mega-pascals | Up to 59 HRC |
| Chrome-silicon spring steel | 5160 | 0.55-0.65% carbon, 0.75-1.00% manganese, 0.7-0.9% Chromium | 669 mega-pascals | Up to 63 HRC |

Figure 9:
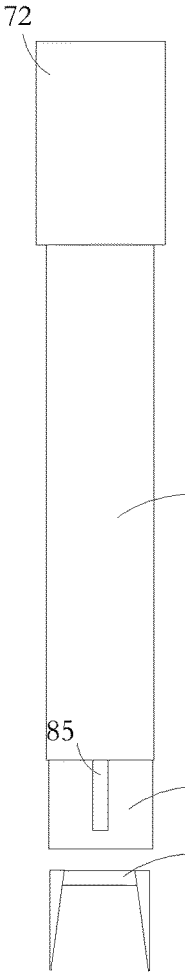
FIG. 9 shows a front elevation of a driver for use in a tool according to an embodiment of the invention.
Figure 10:
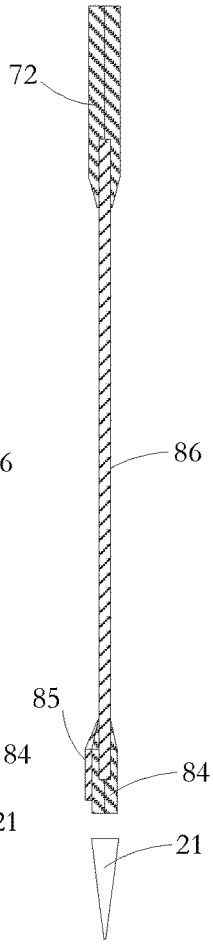
FIG. 10 is a vertical sectional view of the driver of FIG. 9.
Figure 11:
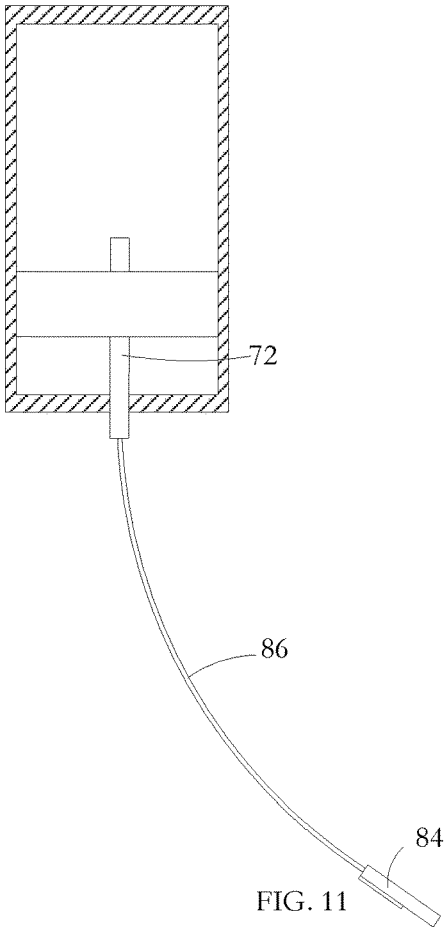
FIG. 11 shows the driver of FIG. 9 in side elevation showing the driver in deployed condition.

The spring steel member 86 is of the order of 0.25 inches in thickness and a half inch in width. It is welded at one end to the rigid driver member 72 and at the other to the blade tip 84 by a tungsten inert gas welding process. As shown in the embodiment of FIGS. 9 to 11, at both ends, the spring steel member 86 is welded between two flanking plates having accommodating rebates. The spring steel member can alternatively be welded at a rebate in one face of the member and blade tip or can be welded as a pair of spring steel members to opposed surfaces of the driver member and the blade tip. In one example, the ends of the member 86 are reduced to 0.125 inches in thickness and welded into a 0.125 inch deep rebate. In another example, the member 86 has an end thickness of 0.125 inches and is welded into 0.065 inch rebates in each of the flanking plates. In the fastener ready position as shown in FIG. 7, the spring steel member 86 is positioned so that an upper part is in the top straight track section 74 and a lower part is in the curved track 88. In a fastener driven position as shown in FIG. 8, an upper part of the spring steel member 86 is in the curved track 88 and a lower part of the spring steel member 86 is in the straight track section 18.

In use, the fastener driving tool 10 is in a resting position as shown in FIG. 3. In this position, within the barrel 12 of the tool, atmospheric pressure exists in the annular area above the actuator 46 and exists also both in the area of lower chamber 30 between the poppet valve head 74 and the disc 62 and in the lower chamber 30 under slider disc 62. Compressed air is continuously fed into reservoir 26 through connector 28 and so chamber 32, which is in in continuous communication with air reservoir 26, is also filled with compressed air. Because the lower face of the actuator 46 has a greater surface area than the upper conical face of valve member head 52, the overall pressure differential on the poppet valve 48 upwardly biases the poppet valve member 70 to an upper limit position to sealingly engaging the valve head against seat 34. Compressed air is also allowed through bores 56 into poppet channel 50 under sleeve 60, to upwardly bias the sleeve 90 and its associated piston 58 to an upper limit position.

When a hammer blow is applied to anvil 40, actuator 48 is driven downwardly in chamber 32 as shown in FIG. 4. Provided the hammer blow has a force sufficient to counteract the pressure differential resulting from the surface area differential between the actuator 46 and the valve member 52, the actuator 46 and poppet member 48 engaged by it are moved downwardly as shown in FIG. 4. Once the valve member 52 is at a lowered position, compressed air can flow around it into lower chamber 30 above disc 62. Since atmospheric pressure exists under disc 62, the latter is suddenly downwardly driven by the incoming compressed air to downwardly drive the drive member 72 as shown in FIG. 5. Since the surface area of upwardly facing disc 62 is greater than the surface area of downwardly facing sleeve 60, the resistance exerted by the sleeve 60 to the downward movement of piston 58 is insignificant. Once piston 58 hits annular pad 76, it reaches its lowermost position.

As shown by FIGS. 7 and 8, the downward movement of member 72 is transmitted to the spring steel member 86 and the blade tip 84. The spring steel member 86 is forced into a curved configuration as it slides against a back wall of the curved track 88. Both the spring steel member and the back wall are burnished to minimize friction between them. Sliding of the spring steel member 86 in the curved track 88 is also facilitated by the application of lubricant. The spring steel member 86 is prevented from moving laterally by the mounting of the drive member 72 in the piston 58 at the upper end of the spring steel member and by the reciprocation of the piston 58 in the barrel body 12. The passage 18 has a groove in its back wall which receives a projecting rib 85 on the blade tip 84 as illustrated in FIGS. 9 to 11. This ensures good tracking of the blade tip 84 in the passage 18. As shown in FIGS. 9 and 10, the blade tip 84 is matched to the head shape of the fastener 21. I.e., it is a blade edge for use in driving a staple and is a circular punch-like tip for driving a nail. In one example, for a 135 degree angle between the vertical percussion direction and the fastener device drive direction, the curved track has a radius of curvature of the order of 1.8 inches.

It can be seen that the vertical reciprocation of the member 72 results in the blade tip driving a staple fastener 21 diagonally into the floorboard 16 as shown in FIG. 8. Moreover, compared with the prior art as illustrated in FIG. 1, it will be apparent that the driving tool 10 can be used to fasten boards 16 that are closer to the "finishing" wall 73 than is possible with the design shown in FIG. 1.

The blow to anvil 40 only temporarily shifts the pressure balance in the tool main body 12. The pressure balance quickly returns to its initial condition after the hammer blow has been effected and the lead fastener has been driven into a floorboard 16. At this point, poppet valve 48 returns to its resting position owing to the greater pressure applied by the compressed air on the bottom of the actuator 46 than on the top of the poppet valve 48. The poppet valve member 48 sealingly engages the seat 34 once again under the bias of the upwardly moving actuator 46. The compressed air in the chamber 30 above disc 62 flows through holes 66 into piston channel 64, through poppet channel 50 (above sleeve 60) and out of tool 10 through exhaust holes 68 and 70. Once the pressure in lower chamber 30 above disc 62 nears atmospheric pressure, the upward pressure applied by the compressed air against sleeve 60 drive piston 58 upwardly in poppet channel 50 back to its initial upper limit position as shown in FIG. 3. The upward movement of piston 58 is dampened when it nears its upper limit position, by the presence of an air cushion at atmospheric pressure in dampening chamber 82.

The fastening tool has some tendency to lift slightly from the flooring when a fastener is expelled due to the outcoming fastener hitting the hard floor, which may result in the fastener not being properly driven into the board and subfloor. Because the hammer blow applied to the anvil 40 is downwardly directed, this helps to prevent the tool from this slight upward reaction.

Figure 12:
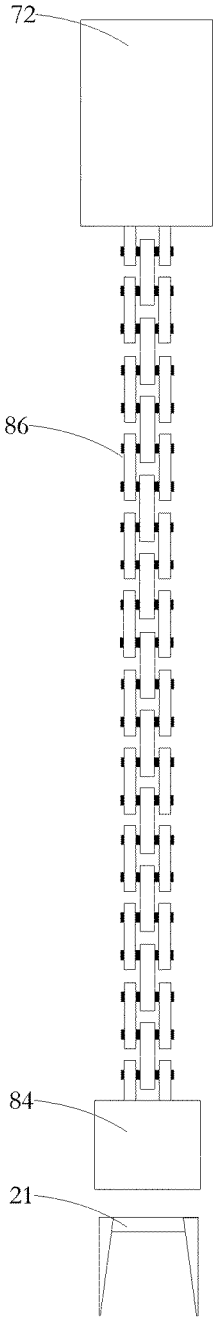
FIG. 12 is a front elevation of an alternative design of driver according to an embodiment of the invention.
Figure 13:
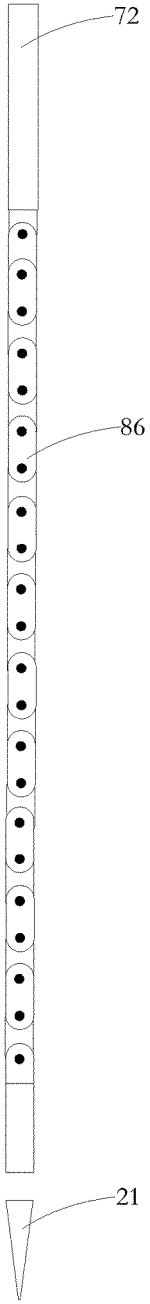
FIG. 13 is a side elevation of the driver of FIG. 12.

The function of the spring steel member 86 housed within the curved track is to convert the downward motion of the anvil to the diagonal motion of the blade tip. Although the spring steel member (or members) 86 is preferred, the transformation in drive direction can be effected with alternative mechanical devices. In one alternative, as shown in FIGS. 12 and 13, the driver flexible central section is implemented by means of linked sections in the manner of a watch band or bicycle chain but configured to adapt the articulated chain to movement within the contiguous passages 74, 88, 18 and configured also to withstand repeated pulsed application of pressure along the longitudinal extent of the chained linkages as the tool is operated to drive in fasteners. In this respect, it will be understood that both in this and the driver embodiments described below, while the blade tip 84 must be matched to the head of the fastener, the implementation of the flexible driver upstream of the blade tip can be as required in order to have the driver withstand the impulse application of pressure at the drive member 72 and the repeated flexures of the central driver section 86.

In other embodiments (not shown), the cross-sectional shape of the spring steel can be other than the rectangular form of the illustrated flexible spring steel ribbon 86. For example, the ribbon may be arcuate, square, circulate, lobed, etc.

Figure 14:
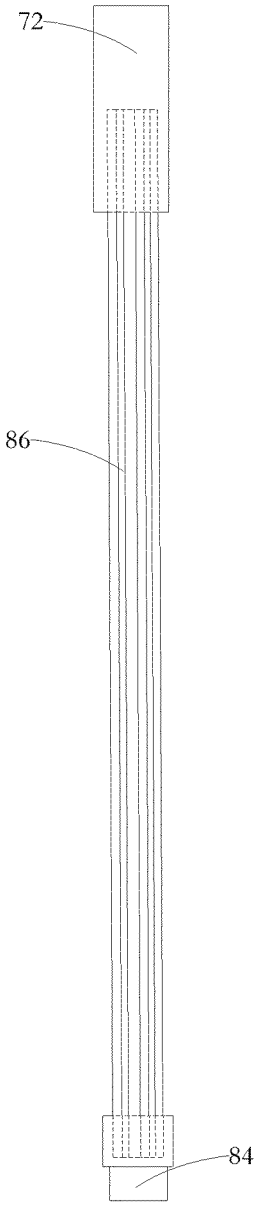
FIG. 14 is a front elevation of an alternative design of driver according to an embodiment of the invention.
Figure 15:
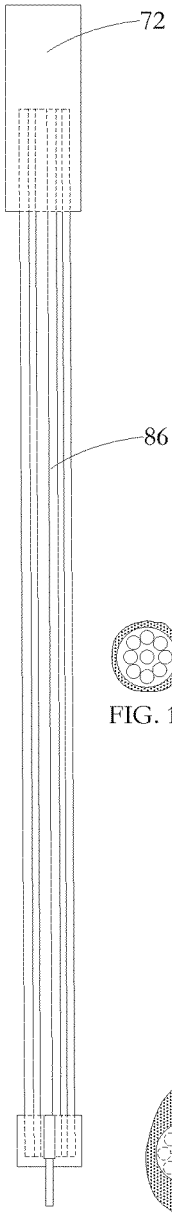
FIG. 15 is a side elevation of the driver of FIG. 14.
Figure 16:
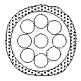
FIG. 16 is a sectional view through a flexible section of the driver of FIG. 14.
Figure 17:
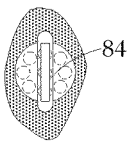
FIG. 17 is an end view of the driver of FIG. 14 at the fastener driving end.

In a further embodiment as shown in FIGS. 14 and 15, the flexible section 86 of the driver is implemented by means of a cable such as aircraft cable which is housed within and moves along a curved track having a cross sectional shape and area to accommodate the cable diameter and to permit the cable to slide relatively freely backwards and forwards along the curved track.

Figure 20:
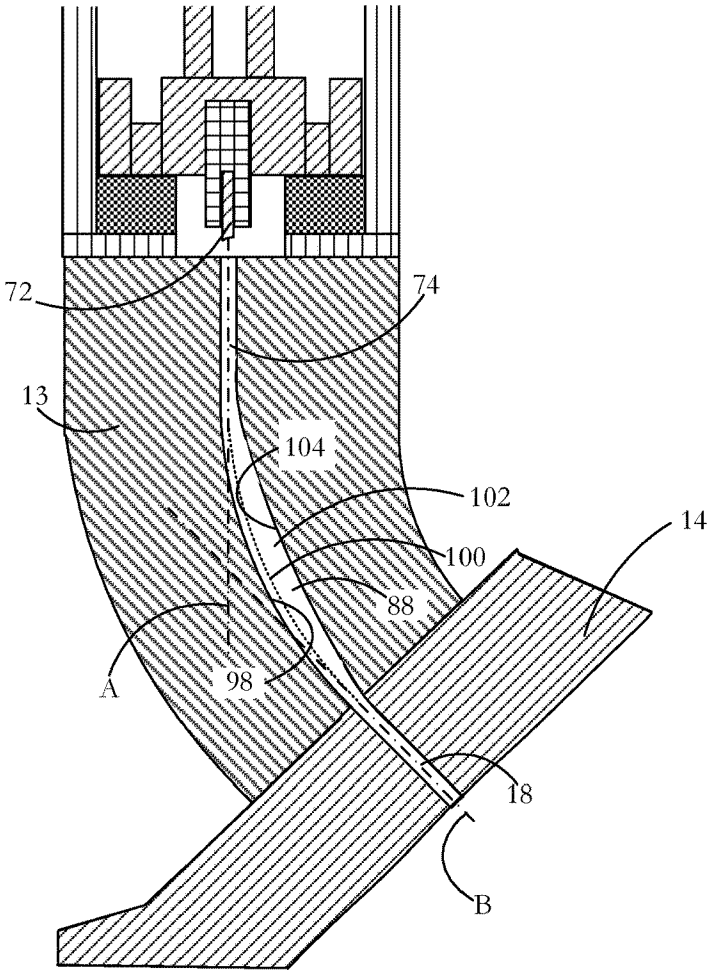
FIG. 20 is a vertical sectional view through part of a lower section of a tool according to another embodiment of the invention, the tool suitable for use with a driver of the form illustrated in FIGS. 18 and 19.
Figure 19:
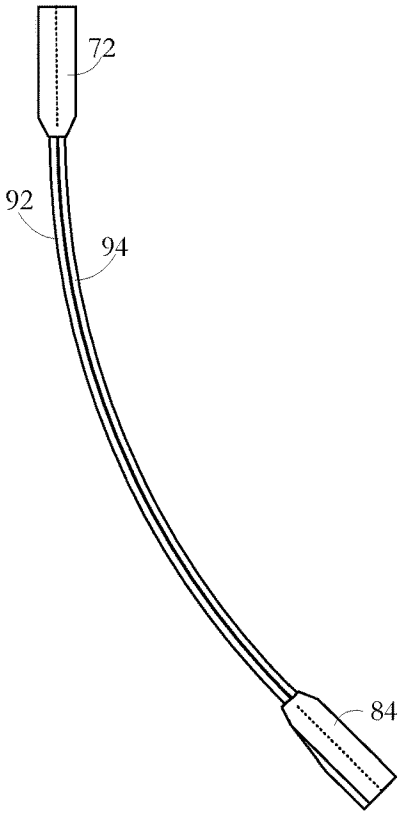
FIG. 19 is a side elevation of the driver of FIG. 18, the driver shown in a loaded condition.
Figure 18:
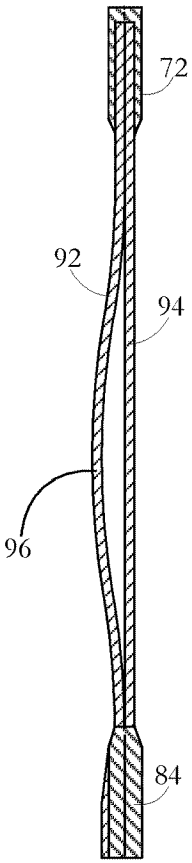
FIG. 18 is a vertical sectional view of an alternative form of flexible driver, the driver shown in an unloaded condition.

In a further embodiment as shown in FIGS. 18-20, FIGS. 18 and 19 show a different form of spring steel device 92, 94 extending between the driver member 72 and the blade tip 84. FIG. 20 shows a tool having a different form of track 88 adapted for use with the spring device 92, 94. As in the embodiment illustrated in FIGS. 7 and 8, the spring steel device 92, 94 is reciprocally moveable within the curved track 88 in the coupling section 13, the curved track contiguous with the track sections 18 and 74. The spring steel device consists of a pair of spring steel ribbons 92, 94 that are joined to each other at respective ends, but which are separate from each other over an intermediate region 96. The ends of the spring steel device are welded or otherwise fixed to the drive member 72 at one end and to the blade tip 84 at the other. In one example, the ends of each ribbon 92, 94 8 is reduced to about 0.07 inches in thickness and welded into a corresponding accommodating rebate or rebates in one or both of the flanking plates. As shown in FIG. 18, which shows the spring steel device in an unloaded condition, the flexible ribbon 92 is longer than the ribbon 94. The two ribbon lengths are set in dependence on the bottom outer surface arc 98 (FIG. 20) and mid-plane arc 100 of the track 88 in the coupling section 13. In use, when the spring steel device is loaded, i.e. during the process of driving a staple or nail, the outer and inner ribbons 92, 94 come together over the intermediate region 96 as shown in FIG. 19.

The double ribbon structure is adopted to minimize fatigue stresses on the flexible driver. If a single thick driver is used, the half of the thick ribbon at the inside curve is in compression as it is driven into and along the curved track, the compression being particularly high at the inner surface. Similarly, the other half of the ribbon at the outside curve is in high tension particularly at the ribbon outer surface. With each drive of a nail/staple the driver is significantly stressed as it is driven into and through the curved path, the stress then being released when the drive is retracted. This cycle causes fatigue wear which, in turn, increases the risk of work hardening of the ribbon causing a gradual loss of flexibility and eventually breakage. In comparison, the ribbons used in the FIG. 18-20 embodiment are subjected to reduced stress across each ribbon 92, 94 leading to a longer driver life. While two ribbons are satisfactory for most practical applications, three or more ribbons of appropriate length can be joined at their respective ends with the resulting device being used as previously described, such an embodiment being valuable for heavy duty operation and for tight curvature implementations.

To further reduce stress on the spring steel device, as shown in FIG. 20, the track 88 is wider over a center region 102 than at the ends where it joins the linear track sections 74 and 18. The outer surface arc 98 is tangent to the vertical driving motion as shown at A and is tangent to the fastener drive direction as shown at B so that the required driving action and orientations are maintained. While the radius of curvature can change depending on geometry of the coupling body 13, the outer surface arc 98 is always selected to be tangent to the two critical directions of motion: the percussion direction from the hammer/piston and the nail/staple drive direction. The value of the variable width curved track is realized in the driver retraction process. When the driver is moved through the arc in a loaded condition, it resembles one member as shown in FIG. 19, with the inner ribbon 94 flexing towards the outer ribbon 92 and the latter travelling along the outer surface arc 98. When the flexible driver begins to retract after the fastener has been driven home, the spring steel device 92, 94 is unloaded and it adopts the form shown FIG. 18. With the larger radius of curvature of the inner surface arc 104 of the curved track 88, the relaxed inner ribbon 94 can pass through the centre of the curved track 88 without scraping along the track inner curved surface which would otherwise cause frictional and mechanical stress. Again, this reduces fatigue damage and increases device lifetime. In one example, for a 135 degree difference between the vertical percussion direction and the fastener device direction, an outer surface radius of 1.81 inches and an inner surface radius of 3.5 inches were adopted over respective center regions of the curved track. While it is preferred that the inner surface is curved, it does not have to have a fixed radius of curvature provided that it provides the required relief.

In each of the embodiments described and illustrated, the track section 74 extends generally vertically. The upper part of the tool can alternatively be configured so that the track section 74 is off-vertical: i.e. the top of the track section inclines slightly towards the wall (when in use) or even inclines slightly away from the wall.

It will be appreciated that in each of the foregoing embodiments, the blade tip is driven by the spring steel driver to eject the readied fastener out of the fastening tool and into the floorboard to be fastened generally at the corner between the bottom edge of the board and the upwardly orientated face of the tongue. The force applied to the fastener is diagonally directed and so one component of this acts to drive the board being fastened against the previously laid board to squeeze the two boards together at the moment of impact.

While the specific embodiments described above relate to a board fastening tool for fastening a floor board to an underlying structure such as a subfloor, it will be appreciated that the principles of the invention can be used on other fastening tools such as trim guns and framing guns where space in relation to a "finishing" wall or other limiting surface or object means that the actuating room for the tool is limited. Tools of a range of sizes, both manually operated and power assisted can use the principles of the invention.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. A board fastening tool having a tool body and first, second and third contiguous drive elements mounted in the tool body, the first element mounted to slide in a first linear direction along a first linear track section within the tool body upon a trailing end of the first element receiving a hammer blow directed generally in the first direction, the second element mounted to slide in a second linear direction different from the first linear direction along a second linear track section whereby a leading end of the second element drives a trailing end of a fastener mounted in the tool body in the second direction, the third element being an elongate, spring metal ribbon device having a trailing end thereof integral with a leading end of the first element and a leading end thereof integral with a trailing end of the second element, the third element mounted to slide along a third curved track section extending between the first and second track sections, the third element conformable to the curvature of the third track section on sliding longitudinally therealong, the spring metal ribbon device having a plurality of spring metal ribbons joined to each other at respective ends thereof and separate from each other over an intermediate region thereof, the third curved track section having a width varying along at least a part of its length in a plane normal to the curve of the third curved track section.

2. The board fastening tool of claim 1, the first and second elements made of hardened steel.

3. The board fastening tool of claim 1, one of the spring steel ribbons being longer than another of the spring steel ribbon, said one spring steel ribbon located towards the outside of the curve of the third curved track section and said other spring steel ribbon located towards the inside of the curve of the third curved track section.

4. The board fastening tool of claim 1, the width of the third curved track section being at a maximum generally at the centre of the third curved track section length and decreasing progressively away from the centre over said at least a part of the section length.

5. The board fastening tool of claim 4, the third curved track section having a first track defining wall on the outside of the curve of the third curved track section, the curve of the first track defining wall being generally tangent to the first and second linear directions.

6. The board fastening tool of claim 5, the curve of the first track defining wall having a radius of curvature of the order of 1.8 inches.

7. The board fastening tool of claim 5, the third curved track section having a second track defining wall on the inside of the curve of the third curved track section, the curve of the first track defining wall not being generally tangent to the first and second linear directions.

8. The board fastening tool of claim 7, the curve of the second track defining wall having a radius of curvature of the order of 3.5 inches.

9. The board fastening tool of claim 1, the second element reciprocally movable along the second track section on an axis inclined at an angle between 30 and 60 degrees to the horizontal when the fastening tool is in an operational position.

10. The board fastening tool of claim 1, the first track section extending generally vertically when the board fastening tool is in the operational position.

11. The board fastening tool of claim 1, the board fastening tool for use with a fastener having a contact end, the second element having a leading tip having a shape generally matching the shape of the fastener contact end.

12. The board fastening tool of claim 1, the first element including a reciprocally drivable anvil for receiving the hammer blow, the anvil linked to a power actuator for triggering generation of a power pulse from a power source to drive the first element along the first track section upon downward movement of the anvil.

13. The board fastening tool of claim 1, the elongate spring metal ribbons generally rectangular in cross section.

14. The board fastening tool of claim 1, the third curved track section generally rectangular in cross section.

15. The board fastening tool of claim 1, the contiguous drive elements drivable in response to the hammer blow applied to the first element to drive the fastener from a stored position in the tool body to a board fastening position.

16. The board fastening tool of claim 15, the contiguous elements reverse drivable along the track sections to return the contiguous elements from the board fastening position to a start position ready to drive a second fastener loaded in the stored position.

17. The board fastening tool of claim 1, a leading end of the second element shaped generally to match an end of one of a nail fastener and a staple fastener.

* * * * *